US011624330B2

(12) United States Patent
Prochazka et al.

(10) Patent No.: US 11,624,330 B2
(45) Date of Patent: Apr. 11, 2023

(54) METHOD FOR OPERATING AN INTERNAL COMBUSTING ENGINE, AND CORRESPONDING INTERNAL COMBUSTION ENGINE

(71) Applicant: AUDI AG, Ingolstadt (DE)

(72) Inventors: Philipp Prochazka, Ingolstadt (DE); Florian Zink, Bad Rappenau (DE); Bernhard Maderer, Altendorf (DE); Christoph Schweitzer, Dalheim (DE); Michael Leihenseder, Neuenstadt (DE); Florian Freund, Würzburg (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 17/283,117

(22) PCT Filed: Nov. 25, 2019

(86) PCT No.: PCT/EP2019/082456
§ 371 (c)(1),
(2) Date: Apr. 6, 2021

(87) PCT Pub. No.: WO2020/126335
PCT Pub. Date: Jun. 25, 2020

(65) Prior Publication Data

US 2021/0388786 A1 Dec. 16, 2021

(30) Foreign Application Priority Data

Dec. 20, 2018 (DE) ..... 10 2018 222 510.9

(51) Int. Cl.
*F02D 41/06* (2006.01)
*F02B 75/18* (2006.01)

(52) U.S. Cl.
CPC ..... *F02D 41/064* (2013.01); *F02B 75/18* (2013.01); *F02D 2200/021* (2013.01); *F02D 2200/04* (2013.01)

(58) Field of Classification Search
CPC ..... F02D 41/064; F02D 2200/021; F02D 2200/04; F02D 31/001; F02D 2200/101; F02D 2250/26; F02B 75/18
See application file for complete search history.

(56) References Cited

U.S. PATENT DOCUMENTS 3,964,457 A * 6/1976 Coscia ..... F02D 41/067 123/360
4,193,380 A * 3/1980 Marchak ..... F02D 41/06 123/480

(Continued)

FOREIGN PATENT DOCUMENTS

CN 104081028 A 10/2014
DE 101 27 760 A1 1/2002

(Continued)

OTHER PUBLICATIONS

Examination Report dated Apr. 26, 2019 in corresponding German application No. 10 2018 222 510.9; 10 pages including Machine-generated English-language translation.

(Continued)

*Primary Examiner* — Sizo B Vilakazi
*Assistant Examiner* — Brian R Kirby
(74) *Attorney, Agent, or Firm* — Maier & Maier, PLLC

(57) ABSTRACT

A method for operating an internal combustion engine having multiple cylinders. A warm-up operation is carried out after the internal combustion engine has been started, during which a speed of the internal combustion engine is limited to a limit value. The limit value is selected during the (Continued)

warm-up operation at least temporarily as a function of a starting temperature of the internal combustion engine.

14 Claims, 1 Drawing Sheet

(56) References Cited

U.S. PATENT DOCUMENTS 4,399,789 A * 8/1983 Yano ..... F02P 5/1558 123/339.22
4,432,325 A * 2/1984 Auracher ..... F02D 37/02 123/406.47
4,702,210 A * 10/1987 Yasuoka ..... F02D 31/005 123/339.23
4,838,230 A * 6/1989 Matsuoka ..... F02D 41/062 123/491
4,987,871 A * 1/1991 Nishikawa ..... F02D 41/061 123/588
5,319,963 A * 6/1994 Benford ..... F16H 59/72 374/141
5,320,079 A * 6/1994 Kuwabara ..... F02D 41/345 123/491
6,523,525 B1 * 2/2003 Hawkins ..... F02D 41/22 123/396
6,843,225 B1 * 1/2005 Ise ..... F02P 15/08 123/339.11
6,948,989 B2 * 9/2005 Watabe ..... F02P 5/1506 440/87
7,487,033 B2 * 2/2009 Hijikata ..... F02D 11/105 123/406.47
9,091,041 B2 * 7/2015 Yoshida ..... E02F 9/2246
9,394,842 B2 * 7/2016 Cunningham ..... F02P 5/1506
9,404,461 B2 * 8/2016 Gibson ..... B60W 30/192
10,100,766 B2 * 10/2018 Yu ..... F02D 41/04
10,597,020 B2 * 3/2020 Christman ..... B60K 6/387
11,280,275 B2 * 3/2022 Fujimoto ..... F02D 31/002
2003/0034009 A1 * 2/2003 Yuya ..... F02D 41/0087 123/436
2003/0221665 A1 * 12/2003 Miyamoto ..... F02D 41/08 123/339.11
2005/0042947 A1 * 2/2005 Saito ..... F02D 31/003 440/84
2005/0252474 A1 * 11/2005 Sah ..... F02N 11/08 123/179.3
2005/0268885 A1 * 12/2005 Almkvist ..... F02D 41/0002 123/305
2007/0199534 A1 * 8/2007 Rockwell ..... F02D 41/064 123/179.16
2008/0276916 A1 * 11/2008 Sekfane ..... F02N 19/00 123/568.21
2009/0082937 A1 * 3/2009 Hokuto ..... F02D 41/3094 701/103
2009/0112443 A1 * 4/2009 Kawamura ..... F02D 19/0631 123/575
2009/0157284 A1 * 6/2009 Bayerle ..... F02D 41/042 701/112
2010/0269787 A1 * 10/2010 Shimamura ..... F02D 41/0205 701/110
2010/0286878 A1 * 11/2010 Lindgren ..... F02D 41/064 701/54
2010/0319659 A1 * 12/2010 Sata ..... F02D 41/0205 123/406.54
2012/0067327 A1 * 3/2012 Kaiser ..... F02D 41/064 123/350
2012/0253633 A1 * 10/2012 Anzawa ..... F02D 41/08 701/102
2013/0000601 A1 * 1/2013 VanDerWege ..... F02D 41/06 477/115
2013/0146024 A1 * 6/2013 Cunningham ..... F02D 41/0255 123/406.53
2014/0007839 A1 * 1/2014 Inoue ..... F02D 41/08 123/406.47
2014/0350800 A1 * 11/2014 Yoshida ..... F02D 29/02 701/50
2015/0322879 A1 * 11/2015 Zeng ..... F02D 41/3094 701/103
2015/0369157 A1 * 12/2015 Lehmen ..... F02D 41/064 701/105
2016/0052508 A1 * 2/2016 Teraya ..... B60W 10/06 903/905
2017/0198654 A1 * 7/2017 Yu ..... F02D 41/0007
2018/0266351 A1 * 9/2018 Coulson ..... F02D 41/064
2019/0293046 A1 * 9/2019 Andersson ..... F02P 9/002
2021/0388786 A1 * 12/2021 Prochazka ..... F02B 75/18

FOREIGN PATENT DOCUMENTS

DE 42 19 362 B4 5/2006
DE 10 2014 106 381 A1 11/2014
DE 10 2017 108 739 A1 10/2017
DE 10 2016 220 292 A1 4/2018
EP 1 108 131 B1 4/2004
EP 2735718 A1 5/2014
EP 3 378 719 A1 9/2018
JP 2003020977 A * 1/2003
JP 2003020977 A * 1/2003
JP 2003254098 A * 9/2003
JP 2006250112 A * 9/2006
JP 2007056857 A 3/2007
JP 2008280914 A 11/2008
JP 2010019153 A * 1/2010
JP 2012013026 A * 1/2012
WO 99/07986 A1 2/1999

OTHER PUBLICATIONS

International Search Report dated Feb. 28, 2020 in corresponding International application No. PCT/EP2019/082456; 7 pages.
Written Opinion of the International Searching Authority dated Feb. 28, 2020 in corresponding International application No. PCT/EP2019/082456; 14 pages.
International Report on Patentability dated Jun. 16, 2021 in corresponding International application No. PCT/EP2019/082456; 14 pages.
Office Action dated Sep. 29, 2022, in corresponding Chinese Patent Application No. 201980082924.1, 16 pages.

* cited by examiner

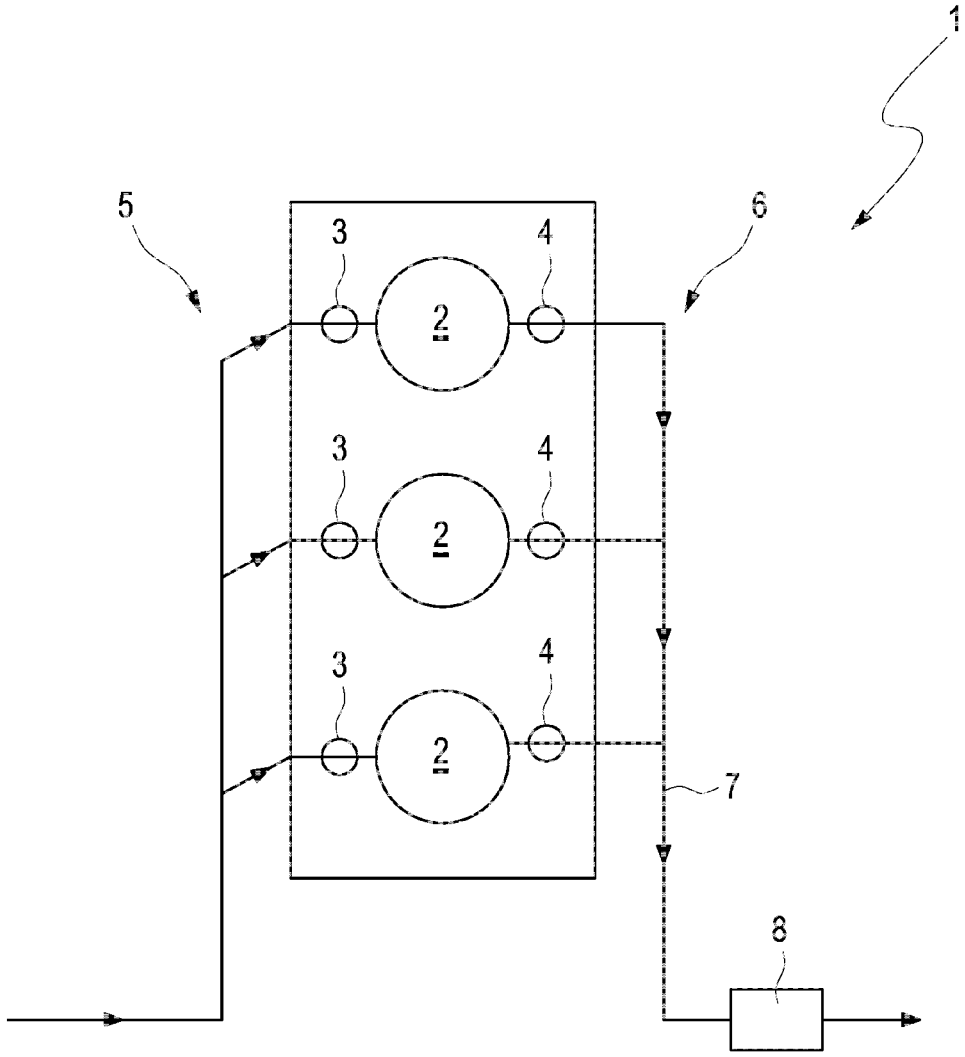
1
5
6
3
4
2
3
4
2
3
4
2
7
8

METHOD FOR OPERATING AN INTERNAL COMBUSTING ENGINE, AND CORRESPONDING INTERNAL COMBUSTION ENGINE

FIELD

The disclosure relates to a method for operating an internal combustion engine having multiple cylinders, wherein a warm-up operation is carried out after the internal combustion engine has been started, during which a speed of the internal combustion engine is limited to a limit value. The disclosure also relates to an internal combustion engine.

BACKGROUND

Document DE 42 19 362 B4, for example, is known from the prior art. This describes an engine speed control unit for an engine equipped with an automatic transmission. The engine speed control unit comprises an overspeed locking device which is actuated at a predetermined limit speed. The overspeed locking device is actuated so that it reduces the engine output power, for example in that the fuel supply to the engine is interrupted, so that the engine is thus prevented from operating at speeds greater than the limit speed. The limit speed is changed as a function of engine operating states, for example as a function of engine temperatures. At the same time, in reaction to a change in the limit speed, a regular upshift vehicle velocity, which is ideally defined by shift control curves in order to carry out upshifts of the automatic transmission as a function of throttle openings, is changed or adjusted as a function of engine temperatures.

SUMMARY

It is the object of the invention to propose a method for operating an internal combustion engine which has advantages over known methods, in particular enables the internal combustion engine to be operated with low emissions, preferably during a warm-up operation of the internal combustion engine.

This object is achieved according to the disclosure by a method for operating an internal combustion engine. It is provided that the limit value is selected during the warm-up operation at least temporarily as a function of a starting temperature of the internal combustion engine.

The method described is used to operate the internal combustion engine, which in turn is preferably used to drive a motor vehicle, that is to say to provide a torque intended to drive the motor vehicle. The internal combustion engine has multiple cylinders, each of which has a combustion chamber.

It is provided that the warm-up operation is to be carried out after the start. During the start, the internal combustion engine is started. The start can comprise, for example, increasing the speed of the internal combustion engine and/or switching on a fuel supply to the internal combustion engine. The speed is particularly preferably increased starting from a standstill of the internal combustion engine, that is to say a speed of zero, up to a minimum speed or an idle speed of the internal combustion engine. The minimum speed of the internal combustion engine corresponds to that speed from which the internal combustion engine can increase its speed further independently, that is to say without external torque supply. The idle speed is that speed at which the internal combustion engine is operated, if it is not used to provide a torque. The idle speed is preferably higher than the minimum speed. For example, the idle speed is selected such that the internal combustion engine runs as smoothly as possible while at the same time consuming as little fuel as possible.

The internal combustion engine is started, for example, after the internal combustion engine has been switched off, in particular in the context of parking the motor vehicle. The starting of the internal combustion engine can also be carried out by an automatic stop-start system. Switching off the internal combustion engine comprises, for example, reducing the speed of the internal combustion engine, in particular down to zero, that is to say until the internal combustion engine is at a standstill, and/or switching off the fuel supply. When the fuel supply is switched off, the internal combustion engine can initially have any speed. For example, when the fuel supply is switched off, the internal combustion engine can be dragged, that is to say driven by means of an external torque.

The internal combustion engine can be switched off, for example, if the motor vehicle is parked. Parking of the motor vehicle is to be understood to mean that the motor vehicle is stopped, that is to say its velocity is reduced to zero. In particular, when the motor vehicle is parked, the driver leaves the motor vehicle at least temporarily. He particularly preferably gets back into the motor vehicle before the starting.

The motor vehicle can be designed as a hybrid vehicle. Not least in this case, the internal combustion engine can also be started while the motor vehicle is traveling, for example when the internal combustion engine is switched on in a regulated manner The internal combustion engine can also be started after the fuel supply has been temporarily switched off, for example during a towing operation or an overrun cut-off of the internal combustion engine. For the start, a speed of the internal combustion engine can be increased to the minimum speed by an electrical machine, for example a starter. After the minimum speed has been reached or already beforehand, the fuel supply is switched on so that the internal combustion engine can be operated under its own power after the start.

After the internal combustion engine has been started, the warm-up operation is carried out. During the warm-up operation, the internal combustion engine is operated in such a way that the speed of the internal combustion engine is limited to a limit value. The speed is preferably a speed of a shaft assigned to the internal combustion engine, in particular a crankshaft or a camshaft. The internal combustion engine is operated at least outside of the warm-up operation in such a way that the speed corresponds to a target speed. The target speed is determined, for example, from the specification of the driver of the motor vehicle and/or the driver assistance device of the motor vehicle. For example, the target speed is determined on the basis of an accelerator pedal position. The internal combustion engine is operated in such a way that the speed is limited to the limit value during the warm-up operation, the speed of the internal combustion engine thus cannot exceed the limit value. At least during the warm-up operation, the speed of the internal combustion engine can be less than the target speed, namely if the limit value is less than the target speed.

It is provided that the limit value of the speed during the warm-up operation is selected at least temporarily as a function of the starting temperature of the internal combustion engine. The starting temperature is a temperature, for example a combustion chamber temperature, at the time of the start of the internal combustion engine. Alternatively, the starting temperature can also be a temperature of the internal combustion engine which corresponds to the combustion chamber temperature or at least approximately correlates with it. The starting temperature can be measured directly by a temperature sensor or determined indirectly on the basis of a model calculation. The model calculation can take into consideration available sensor data, such as an outside temperature, a previous operating duration of the internal combustion engine, or the duration of a standstill of the internal combustion engine preceding the start. The model calculation can be carried out in a control device assigned to the internal combustion engine. The limit value is selected during the warm-up operation as a function of the starting temperature. In other words, the limit value is selected as a function of the combustion chamber temperature at the time of the start of the internal combustion engine, which is measured directly or estimated by the model calculation.

Using the procedure described, the pollutant emissions of the internal combustion engine that occur during the start or after the start of the internal combustion engine can be significantly reduced, namely by reducing the speed of the internal combustion engine during the warm-up operation. An external-ignition internal combustion engine, in particular a gasoline internal combustion engine, is preferably used as the internal combustion engine.

A particularly preferred embodiment of the invention provides that a cylinder charge of the cylinders is limited to a limit value at least temporarily during the warm-up operation. The cylinder charge is understood to mean an amount of a mixture of fresh gas and fuel supplied to the cylinders, in particular their combustion chamber, during an intake stroke. The fresh gas can consist entirely of fresh air or at least include fresh air. For example, the fresh gas is composed of fresh air and exhaust gas, namely if exhaust gas recirculation is carried out. The fresh gas is introduced at least outside of the warm-up operation in such a way that, after the introduction, there is an amount of the mixture in the combustion chamber which corresponds to a target amount. This target amount is determined, for example, from a specification of a driver of the motor vehicle and/or a driver assistance device of the motor vehicle.

During the warm-up operation, it can be provided that the cylinder charge is limited to the limit value. In this case there are preferably multiple limit values, namely one for the cylinder charge and one for the speed. This means that both the cylinder charge and also the speed are each limited to a separate limit value during the warm-up operation. The cylinder charge can therefore be at least temporarily less than the target amount, namely if the limit value is less than the target amount. In other words, the cylinder charge is prevented from exceeding the limit value during the warm-up operation. The limiting can be carried out by means of the control device assigned to the internal combustion engine, which adjusts the cylinder charge by activating a corresponding adjusting element, for example a throttle valve. The cylinder charge is preferably the charge of each individual one of the cylinders, that is to say in particular not the cylinder charge of all cylinders together. The cylinder charge of each individual one of the cylinders is thus limited to the limit value in each case. In the following explanations, the limit value is always discussed; however, in the case of the multiple limit values, the explanations apply accordingly to both the limit value of the speed and the limit value of the cylinder charge.

In a further preferred embodiment it is provided that the warm-up operation is only carried out when the starting temperature of the internal combustion engine is below a minimum temperature. As already explained above, the speed of the internal combustion engine is limited to the limit value during the warm-up operation. As a result, the torque intended to drive the motor vehicle is also limited during the warm-up operation. The minimum temperature is provided in order not to limit the torque that can be called up to drive the internal combustion engine after a very brief standstill of the internal combustion engine, during which the cooling of the internal combustion engine only progresses slightly.

The minimum temperature can be selected as a function of the ambient temperature. For example, a lower minimum temperature can be provided at a lower ambient temperature, while a higher minimum temperature is provided at a higher ambient temperature. If the starting temperature determined at the time of the start is less than the minimum temperature, the warm-up operation described above is carried out during the start of the internal combustion engine. If the starting temperature determined at the time of the start of the internal combustion engine is above the minimum temperature, the warm-up operation is not carried out during the start, but instead, for example, a normal operation in which the speed is not limited to the limit value.

One refinement of the invention provides that the limit value is set at the beginning of the warm-up operation to a starting value selected as a function of the starting temperature of the internal combustion engine. As already explained above, the starting temperature describes the combustion chamber temperature of the internal combustion engine and can therefore be used as a measure of the progressive cooling of the internal combustion engine. It can be useful to select the limit value of the speed selected during the warm-up operation as a function of the starting temperature and thus the cooling of the internal combustion engine.

For example, it can be provided that if the cooling has only progressed slightly, the warm-up operation is carried out using a higher limit value and, if the cooling has progressed further, a lower limit value is selected. For this purpose, the starting value that is set at the beginning of the warm-up operation is defined for the limit value. A minimum value can also be determined for this starting value in order to limit the selection of the limit value downwards. The starting value is therefore not selected exclusively as a function of the starting temperature of the internal combustion engine; in particular, the selection of the starting value for providing a minimum torque can be limited by the minimum value. Additionally or alternatively, it can be provided that the starting value is selected as a function of the ambient temperature. For example, a lower starting value can be set at a lower ambient temperature and a higher starting value can be set at a higher ambient temperature.

Another embodiment of the invention provides that the limit value is increased during the warm-up operation starting from the starting value in the direction of an end value. For this purpose, an end value is defined for the limit value, wherein this can be a maximum permissible value which may be present during intended continuous operation of the internal combustion engine without damage to the internal combustion engine occurring or being expected. The end value will always be higher than the starting value and the limit value will be increased in the direction of the end value during warm-up operation.

Additionally or alternatively, it can be provided in the scope of a refinement of the invention that the end value is selected as a function of the starting temperature of the internal combustion engine. In the case of progressive cooling of the internal combustion engine, it can be advantageous that the end value is not set to the maximum permissible value, but is selected as a function of the starting temperature. Since the starting temperature describes the combustion chamber temperature of the internal combustion engine, a lower end value can be selected if the cooling has already progressed further. Alternatively or additionally, the end value can be selected as a function of the ambient temperature.

One refinement of the invention provides that the increase takes place linearly or in steps. As already explained above, the limit value is increased in the direction of the end value during the warm-up operation. This increase can take place linearly, for example at a defined rate of increase, in particular at a rate of increase that is constant during the warm-up operation. Alternatively, the increase can also take place in steps. The step-by-step increase can take place in fixed time steps, wherein the limit value is increased by a fixed value in each time step.

Another additional or alternative embodiment of the invention provides that the increase takes place as a function of an amount of air supplied to the internal combustion engine and/or a further temperature of the internal combustion engine. The cumulative amount of air supplied to the cylinders since the internal combustion engine was started can be used as a measure of the amount of heat generated by the internal combustion engine during its operation. The cumulative amount of air supplied, in particular the amount of fresh gas, is understood to mean the total amount of air or fresh gas supplied to the cylinders since the internal combustion engine was started. The quantity can be a mass or a volume. The amount of air supplied to the cylinders in each intake stroke is accumulated or cumulatively added.

If the internal combustion engine is operated at a higher load, it will heat up more quickly and, accordingly, the cumulative amount of air will increase more rapidly than at a lower load. It can therefore be useful to increase the limit value as a function of the cumulative amount of air supplied to the cylinders in order to take into consideration the speed at which the internal combustion engine is warmed up during operation. Alternatively, a further temperature of the internal combustion engine can be used as a measure of the progress of the warming-up process, for example a coolant temperature or a temperature of an exhaust system.

Finally, within the scope of a further preferred embodiment of the invention, it can be provided that the warm-up operation is ended when the limit value reaches the end value and/or the amount of air supplied to the cylinders exceeds a threshold value. As already explained above, the limit value is increased in the direction of the end value during the warm-up operation. It can therefore be useful to end the warm-up operation when the limit value reaches or exceeds the end value. After the warm-up operation has ended, the internal combustion engine can be operated in normal operation, during which the measures described above are no longer carried out. If there is a limit value for both the cylinder charge and also the speed, the warm-up operation can be ended when one of the limit values reaches the end value. Alternatively, it can be provided that the warm-up operation is only ended when both limit values have reached their respective end values.

Additionally or alternatively, it can be provided that the cumulative amount of air supplied to the cylinders since the start is used as a measure of the thermal energy converted by the internal combustion engine and the warm-up operation is ended as soon as this amount of air reaches or exceeds the threshold value. From the point in time when it is exceeded, it can be assumed that the internal combustion engine has reached its operating temperature. After the internal combustion engine has been switched off again, the warm-up operation can be carried out again according to the method described above. In particular, the warm-up operation can be carried out after each start on the basis of the above explanations.

The invention furthermore relates to an internal combustion engine having multiple cylinders, in particular for carrying out the method according to one or more of the preceding claims, wherein a warm-up operation is carried out after the internal combustion engine has been started, during which a speed of the internal combustion engine is limited to a limit value. It is provided that the internal combustion engine is designed to select the limit value during the warm-up operation at least temporarily as a function of a starting temperature of the internal combustion engine. In particular, the internal combustion engine can have an engine control device for implementing the method.

The advantages of such a procedure and of such an embodiment of an internal combustion engine have already been discussed. Both the internal combustion engine and the method for its operation can be refined according to the explanations within the scope of this description, to which reference will therefore be made.

BRIEF DESCRIPTION OF THE FIGURE

In the following, the invention will be explained in greater detail with reference to the exemplary embodiments depicted in the drawings, without this restricting the invention. In the sole figure, FIG. 1 shows a schematic illustration of an internal combustion engine.

The FIGURE shows a schematic illustration of an internal combustion engine 1, which has multiple cylinders 2 in the exemplary embodiment shown here. Each of the cylinders 2 has at least one inlet valve 3 and at least one outlet valve 4. Fresh gas can be supplied to the respective cylinder 2 from an intake tract 5 via each of the inlet valves 3, whereas exhaust gas can escape from the corresponding cylinder 2 through each of the outlet valves 4, namely in the direction of an exhaust tract 6. Downstream of the exhaust tract 6 there can be an exhaust gas purification device 8, which is fluidically connected to the outlet valves 4 via an exhaust gas line 7. The exhaust gas purification device 8 can, for example, have at least one catalytic converter.

The internal combustion engine 1 is operated by means of a method according to which a warm-up operation is carried out after the internal combustion engine has been started. The speed of the internal combustion engine 1 is limited to the limit value. Fresh gas is supplied to the cylinders 2 via the intake tract 5, wherein this fresh gas supply can additionally be limited to a limit value during the warm-up operation. In this respect, two limit values can thus exist, namely one for the speed of the internal combustion engine and one for the cylinder charge. The limit value or values are selected during the warm-up operation at least temporarily as a function of a starting temperature of the internal combustion engine 1.

For example, the internal combustion engine 1 is designed to determine the combustion chamber temperature at the time of the start of the internal combustion engine 1 in order to use this as the starting temperature. To determine the combustion chamber temperature, temperature sensors can be provided in the internal combustion engine 1. Additionally or alternatively, the combustion chamber temperature can be determined on the basis of a model calculation. The model calculation can calculate the combustion chamber temperature or the starting temperature using sensor data, such as an outside temperature, as well as the time curve of a standstill of the internal combustion engine 1 preceding the start of the internal combustion engine 1. If the measured or calculated starting temperature is below a minimum temperature, the warm-up operation is thus carried out.

At the beginning of the warm-up operation, the limit value is set to a starting value. During the warm-up operation, the limit value is increased starting from the starting value in the direction of an end value. The end value is selected, for example, so that the limit value of the speed reaches a maximum permissible speed which, in normal operation, may be present after the operating temperature has been reached, without damage to the internal combustion engine 1 occurring or being expected. In addition, a maximum permissible end value can also be defined for the limit value of the cylinder charge.

The limit value is increased in the direction of the end value, wherein the increase takes place as a function of the amount of air supplied cumulatively to the cylinders 2 via the intake tract 5 since the start. When the limit value reaches the end value, the warm-up operation is ended. Additionally or alternatively, it can be provided that the warm-up operation is ended as soon as the amount of air supplied cumulatively to the cylinders 2 since the start exceeds a threshold value. In this way, the internal combustion engine 1 is heated to an operating temperature in a controlled manner during the warm-up operation, and the pollutant emissions of the internal combustion engine 1 are accordingly significantly reduced during the warm-up operation.

The invention claimed is:

1. A method for operating an internal combustion engine having a plurality of cylinders, comprising:

carrying out a warm-up operation after the internal combustion engine has been started, wherein a speed of the internal combustion engine is normally controlled to a target speed commanded by at least one of a driver and a driver assistance system, wherein, during the warm-up operation, the speed of the internal combustion engine is controlled to a speed limit value which differs from the target speed, wherein, during the warm-up operation, at least one charge limit value limits a cylinder charge of each of the plurality of cylinders, and wherein the speed limit value and the at least one charge limit value are each selected based on at least a starting temperature of the internal combustion engine, wherein the speed limit value and the at least one charge limit value are each set to a starting value at a beginning of the warm-up operation and progress towards an end value during the warm-up operation, wherein the starting values and the end values are each determined as a function of the starting temperature of the internal combustion engine.

2. The method according to claim 1, wherein the starting temperature is determined according to a computer model based on a previous operating duration of the internal combustion engine and a duration of a standstill of the internal combustion engine preceding a start.

3. The method according to claim 1, wherein the warm-up operation is only carried out when the starting temperature of the internal combustion engine is less than a minimum temperature.

4. The method according to claim 1, wherein progression of the speed limit value and the at least one charge limit value takes place linearly or in steps.

5. The method according to claim 1, wherein progression of the speed limit value and the at least one charge limit value takes place as a function of a cumulative amount of air supplied to the internal combustion engine since the internal combustion engine was started.

6. The method according to claim 1, wherein the warm-up operation is ended when at least one of the speed limit value and the at least one charge limit value have reached their respective end value.

7. An internal combustion engine having a plurality of cylinders and a control device for carrying out the method according to claim 1.

8. The method according to claim 3, wherein the minimum temperature is determined as a function of at least an ambient temperature.

9. The method according to claim 1, wherein determination of the starting values is bounded by a minimum value corresponding to a minimum torque to be supplied by the internal combustion engine.

10. The method according to claim 1, wherein the starting values are further determined based on a progression of cooling of the internal combustion engine.

11. The method according to claim 6, wherein the warm-up operation is ended when both the speed limit value and the at least one charge limit value have reached the end value.

12. The method according to claim 5, wherein the warm-up operation is ended when the cumulative amount of air supplied to the internal combustion engine since the internal combustion engine was started exceeds a predetermined threshold.

13. The method according to claim 1, wherein a torque provided by the internal combustion for driving a motor vehicle is reduced due to the warm-up operation.

14. The method according to claim 1, wherein the starting values and the end values are further determined based on an ambient temperature.

* * * * *